US010755617B2

(12) United States Patent
Lee

(10) Patent No.: US 10,755,617 B2
(45) Date of Patent: Aug. 25, 2020

(54) DE-MURA AMENDMENT METHOD OF DISPLAY PANEL

(71) Applicant: Trisys Co., Ltd, Seongnam-si (KR)

(72) Inventor: Seung Won Lee, Osan-si (KR)

( * ) Notice: Subject to any disclaimer, the term of this patent is extended or adjusted under 35 U.S.C. 154(b) by 0 days.

(21) Appl. No.: 16/068,458

(22) PCT Filed: Dec. 21, 2017

(86) PCT No.: PCT/KR2017/015216

§ 371 (c)(1),
(2) Date: Jul. 12, 2018

(87) PCT Pub. No.: WO2018/128308

PCT Pub. Date: Jul. 12, 2018

(65) Prior Publication Data

US 2020/0168139 A1 May 28, 2020

(30) Foreign Application Priority Data

Jan. 6, 2017 (KR) ..... 10-2017-0002153

(51) Int. Cl.
*G09G 3/00* (2006.01)

(52) U.S. Cl.
CPC ..... *G09G 3/006* (2013.01); *G09G 2300/0819* (2013.01); *G09G 2320/0673* (2013.01); *G09G 2320/0693* (2013.01)

(58) Field of Classification Search
CPC ..... G09G 3/006; G09G 2300/0819; G09G 2320/0673; G09G 2320/0693
See application file for complete search history.

(56) References Cited

U.S. PATENT DOCUMENTS

| | | | |
|---|---|---|---|
| 8,106,866 | B2 | 1/2012 | Wang |
| 8,624,942 | B2 | 1/2014 | Jeon |
| 2006/0238551 | A1 | 10/2006 | Dalal |

FOREIGN PATENT DOCUMENTS

| | | |
|---|---|---|
| KR | 102050123158 | 12/2005 |
| KR | 1020120028037 | 3/2012 |
| KR | 1020140129727 | 11/2014 |

OTHER PUBLICATIONS

English Abstract of KR 10-205-0123158 2005.
International Search Report for PCT/KR/2017/015216 dated Jan. 6, 2017.
English Translation of Abstract of KR 10-2014-0129727 2014.
English Translation of Abstract of KR 10-2012-0028037 2012.

*Primary Examiner* — Priyank J Shah

(57) ABSTRACT

A unit light source module configured as a 3D display system includes a light emitting unit including a plurality of point light sources corresponding to a number of viewpoints and a light collecting unit disposed a predetermined distance apart from the light emitting unit and collecting and outputting the light source outputted from the plurality of point light sources.

5 Claims, 5 Drawing Sheets

DE-MURA AMENDMENT METHOD OF DISPLAY PANEL

PRIORITY

This application is a National Stage filing under 35 U.S.C. § 371 of, and claims priority via, International Application No. PCT/KR2017/015216 for DE-MURA AMENDMENT METHOD OF DISPLAY PANEL, filed Dec. 21, 2017, and pursuant to 35 U.S.C. § 119, this application also claims the benefit of earlier filing date and right of priority to Korean Patent Application Number 10-2017-0002153, filed on Jan. 6, 2017. The entire content of PCT/KR2017/015216 is hereby incorporated by reference. The entire content of Korean Patent Application Number 10-2017-0002153 is hereby incorporated by reference.

The teachings in accordance with exemplary and non-limiting embodiments of the present invention relate generally to a de-mura amendment method of display panel (hereinafter referred to as "mura correcting method of display panel)", and more particularly, to a mura correcting method of display panel configured to correctly light the display panel by inputting a target gray instead of reference gray by deriving a reference gray for outputting a target gray and an actually-inputted target gray when the display panel is lit.

BACKGROUND

A display panel is a panel to display information through a screen, and widely used for home-appliances. Recently, an LCD is commonly used as an example of display panel.

In general, an LCD is a display device widely used in the related industries as a display device developed to replace a cathode ray tube used for a monitor of a TV or a computer, because of strong point of being easy in miniaturization, having a high quality and low power consumption.

Particularly, concomitant with recent continued expansion of demand of mobile communication terminals such as mobile phones and PDAs, markets for small display panels mounted on mobile communication terminals are being exponentially expanded.

The display panels pass through various correcting processes during manufacturing for mura, chromaticity, color shading and contrast. At this time, as the mobile communication terminals are gradually mounted with color display panels that require high degrees of technologies and qualities, an accurate correction is essentially involved, and improvement of efficiency in correcting process is also accompanied in association with full scale of mass production.

As noted from the foregoing, as the display markets are activated, various types of display correcting methods are being developed.

Accordingly, the present invention is provided to solve the aforementioned problems, and therefore, it is an object of the present invention to provide a mura correcting method of display panel configured to derive a target gray for outputting a target luminance to allow deriving a target luminance desired from a reference gray which is an input value when a display panel is lit, through which a change rate of the reference gray and the target gray can be derived to correct the lighting of the display panel.

It should be emphasized, however, that the present invention is not limited to a particular disclosure, as explained above. It should be understood that other technical subjects not mentioned herein may be appreciated by those skilled in the art.

In order to accomplish the above object, in one general aspect of the present disclosure, there is provided a mura correcting method of display panel for correction when a display panel is lit, the method comprising:

applying a current corresponding to a first reference gray to the display panel to thereby light the display panel, and measuring a first measurement luminance thereto (first luminance measurement step);

measuring a luminance of adjacent other gray from the first reference gray and deriving a first gamma curve to a luminance change based on the first measurement luminance (first gamma curve deriving step);

setting an actual luminance corresponding to the first reference gray as a first target luminance, and deriving a first target gray corresponding to the first target luminance from the first gamma curve (first target gray deriving step);

lighting the display panel by applying a current corresponding to a second reference gray separate from the first reference gray and measuring a second measurement luminance thereto (second luminance measurement step);

measuring a luminance of adjacent other gray from the second reference gray and deriving a second gamma curve to a luminance change based on the second measurement luminance (second gamma curve deriving step);

setting an actual luminance corresponding to the second reference gray as a second target luminance, and deriving a second target gray corresponding to the second target luminance from the second gamma curve (second target gray deriving step); and deriving a correction value graph using a first target gray value and a second target gray value respectively corresponding to the first reference gray and the second reference gray (correction value deriving step), wherein the display panel is lit by applying a current corresponding to the corrected gray instead of relevant gray using the correction value graph when the display panel is lit.

Preferably, but not necessarily, the first gamma curve deriving step may include:

setting a different first comparison gray within a pre-set first measurement area that is adjacent to the first reference gray (first process);

lighting the display panel by applying to the display panel a current corresponding to the first comparison gray, and measuring a first comparison luminance thereto (second process); and deriving a first gamma curve relative to a luminance value change within the first measurement area by using the first measurement luminance and the first comparison luminance (third process).

Preferably, but not necessarily, the second gamma curve deriving step may include:

setting a different second comparison gray within a pre-set second measurement area that is adjacent to the second reference gray (fourth process);

lighting the display panel by applying to the display panel a current corresponding to the second comparison gray, and measuring a second comparison luminance thereto (fifth process); and deriving a second gamma curve relative to a luminance value change within the second measurement area by using the second measurement luminance and the second comparison luminance (sixth process).

Preferably, but not necessarily, the correction value deriving step may include deriving a slope (a) of the correction value graph using a numerical expression of G2'−G2=a(G1'−G1)G2'−G2=a(G1'−G1), where G1: first reference gray G1': first target gray G2: second reference gray G2': second target gray.

Preferably, but not necessarily, the correction value graph may be derived by a graph with a shape of linear function where a reference gray value and a target gray value respectively form an axis, wherein the display panel is lit by inputting the target gray value corresponding to the reference gray value.

Exemplary embodiments of the present invention have the following advantageous effects in order to solve the aforementioned problems:

First, a separate gamma curve is derived by deriving a comparison luminance adjacent to a measurement luminance relative to a reference gray when lighting of display panel is tested, and a target gray is derived in order to output a target luminance through the derived gamma curve, whereby a correct target gray can be advantageously outputted by correcting the reference gray using the target gray;

Second, generation of error can be advantageously minimized by separately deriving a gamma curve of a section corresponding to within a measurement area by setting a pre-set separate measurement area in a reference gray and by deriving a plurality of comparison luminance within the measurement area;

Third, a correction of lighting of a display panel can be simply implemented by independently deriving a target gray from each area by setting a plurality of measurement areas, through which a correction value graph can be derived that shows a change rate of target gray in response to changes in reference gray.

It should be emphasized, however, that the advantageous effects of the present invention are not limited to particular disclosures, as explained above. It should be understood that other advantageous effects not mentioned herein may be clearly appreciated by those skilled in the art.

Exemplary embodiments of the present invention thus described will be explained hereinafter with reference to the accompanying drawings. However, the exemplary embodiments are not to limit the present invention to particular shapes, but to help appreciate the present invention more clearly through the exemplary embodiments.

The mura correcting method of display panel prevents mura (modified uniformly redundant array, non-uniformity distortions, phenomena of uneven screen display from generating on an entire display panel by correcting through the display panel being lit with a correct luminance in response to a gray inputted through a luminance value measured when testing the lighting of a manufactured display panel.

Hereinafter, the mura correcting method of display panel according to the present invention will be described with reference to FIGS. 1 to 5.

Figure 1:
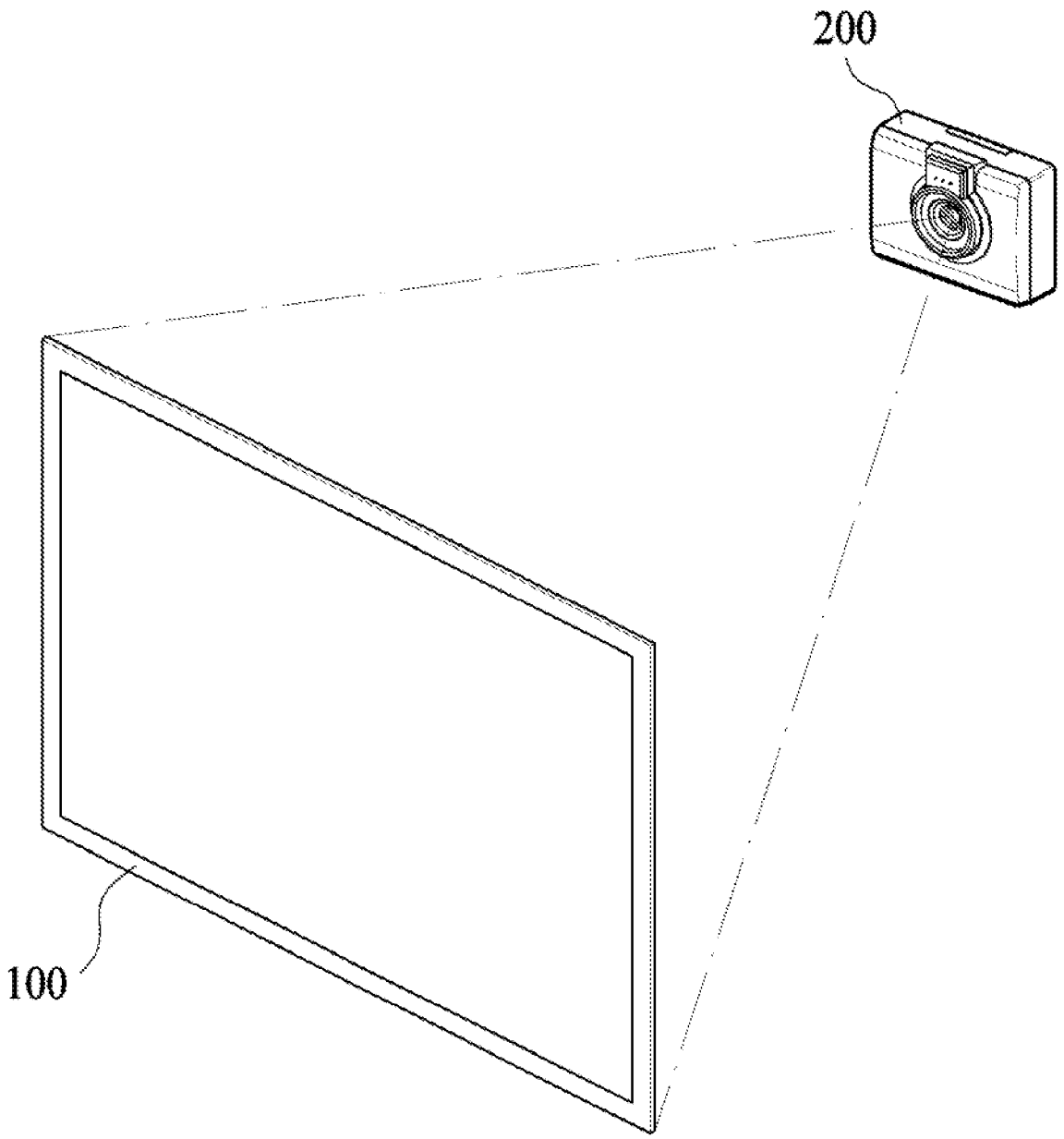
FIG. 1 is a schematic view illustrating a state in which lighting of display panel is photographed by a photographing unit in a mura correcting method of display panel according to the present invention.
Figure 2:
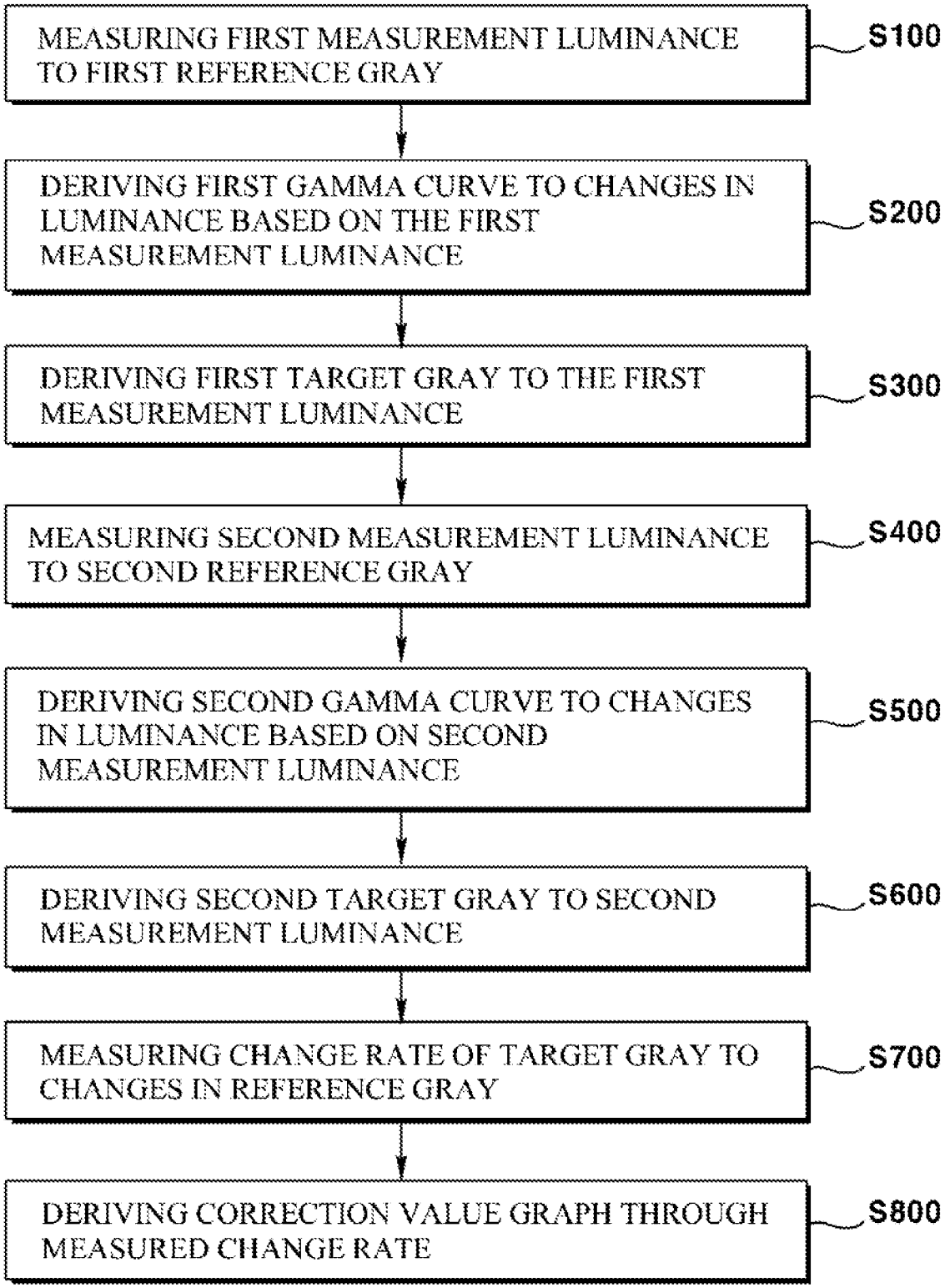
FIG. 2 is a schematic view illustrating an entire progressing process of a mura correcting method of display panel according to the present invention.
Figure 3:
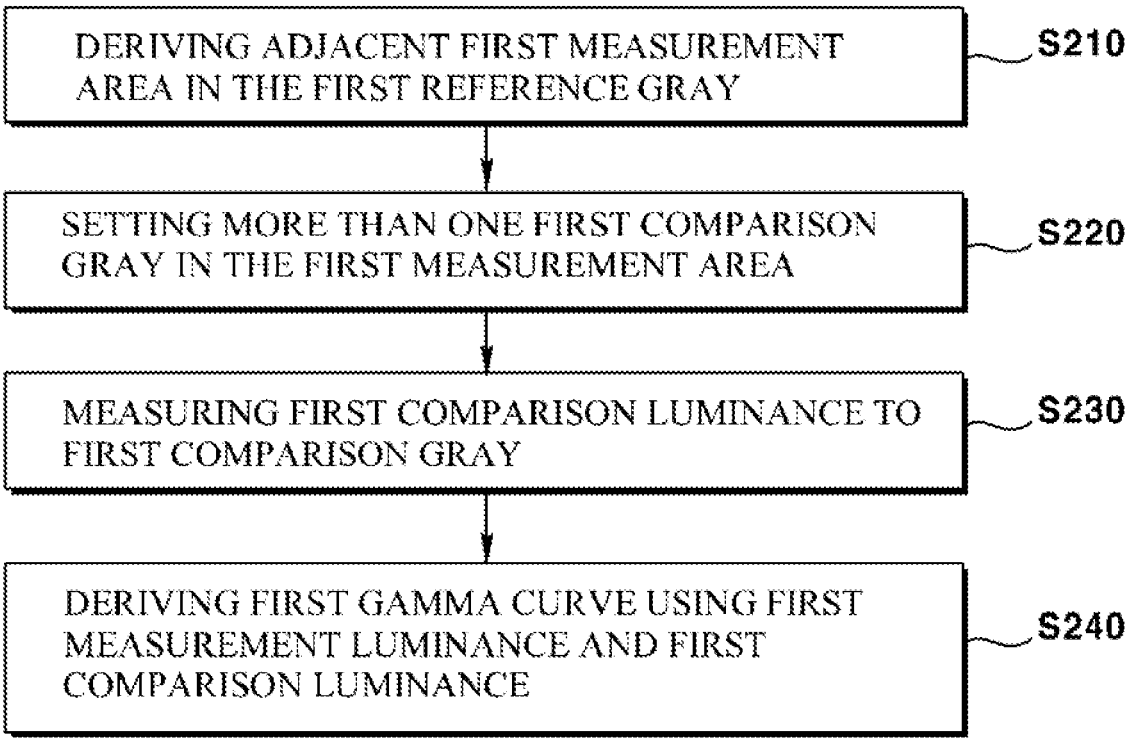
FIG. 3 is a schematic view illustrating a process deriving a first gamma curve in FIG. 2.
Figure 4:
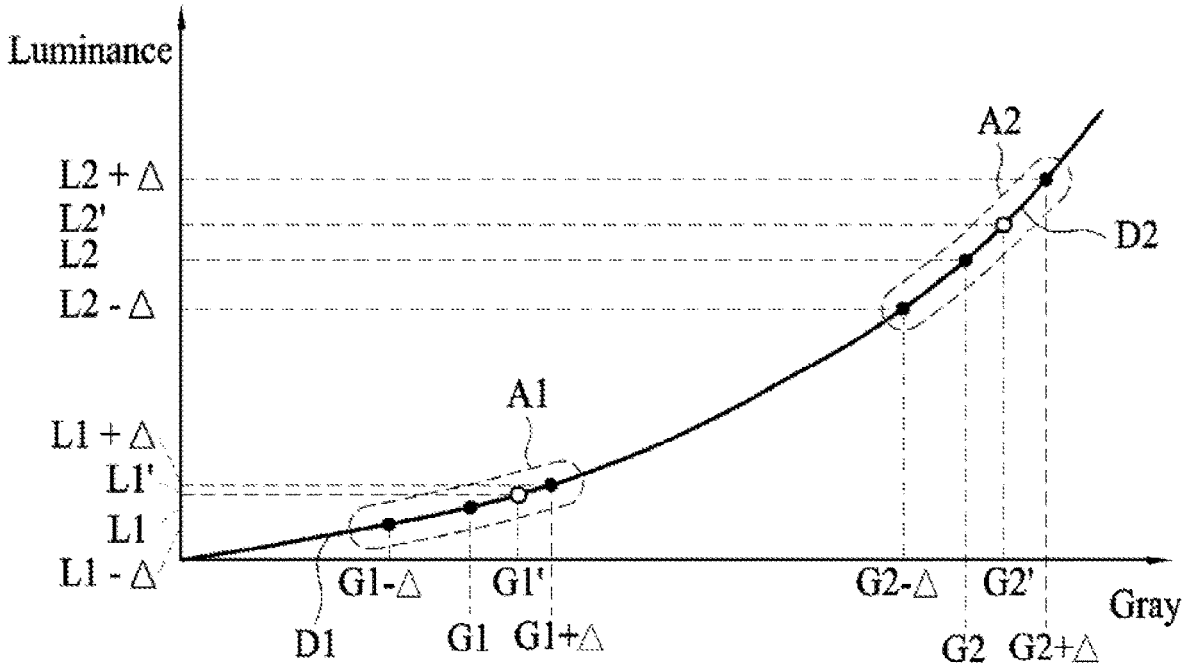
FIG. 4 is a schematic view illustrating a gamma curve relative to luminance changes in a mura correcting method of display panel of FIG. 1.
Figure 5:
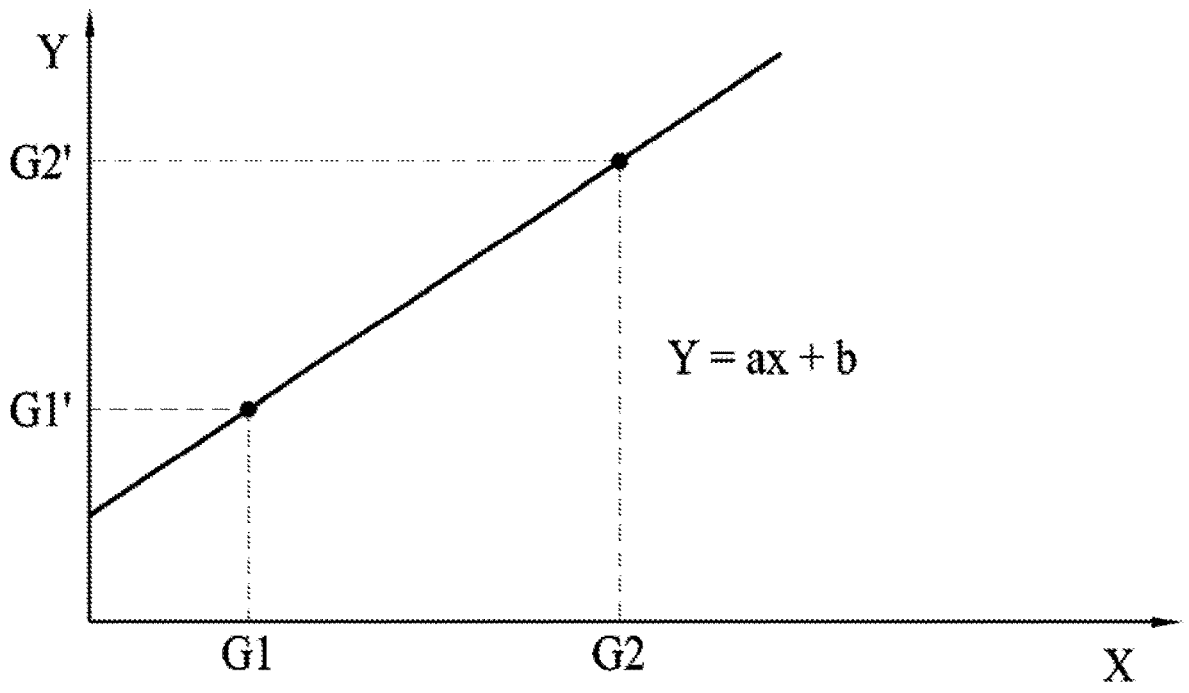
FIG. 5 is a schematic view illustrating a correction value graph in a mura correcting method of display panel of FIG. 1.

FIG. 1 is a schematic view illustrating a state in which lighting of display panel is photographed by a photographing unit in a mura correcting method of display panel according to the present invention, FIG. 2 is a schematic view illustrating an entire progressing process of a mura correcting method of display panel according to the present invention, and FIG. 3 is a schematic view illustrating a process deriving a first gamma curve in FIG. 2;

Furthermore, FIG. 4 is a schematic view illustrating a gamma curve relative to luminance changes in a mura correcting method of display panel of FIG. 1, and FIG. 5 is a schematic view illustrating a correction value graph in a mura correcting method of display panel of FIG. 1.

In general, a phenomenon of mura (stain, spot) is generated on an entire surface of display panel when a current corresponding to a set luminance is applied when each pixel is lit on the display panel, and luminance outputted from the pixels is not correctly outputted. Thus, in order to prevent the mura thus described from being generated, there is a need to correct the luminance outputted from the pixels, as described in the present invention. Furthermore, the mura can be prevented from being generated by correction in which the luminance is evenly outputted from each pixel of the display panel.

To be more specific, the mura correcting method of display panel according to the present invention may largely include a first luminance measurement step (S100), a first gamma curve deriving step (S200), s first target gray deriving step (S300), s second luminance measurement step (S400), a second gamma curve deriving step (S500), a second target gray deriving step (S600) and a correction value deriving step (S800).

First, a current is applied to a display panel (100) to light the display panel (100) when the lighting of display panel (100) is tested as illustrated in FIG. 1, and luminance is measured using a discretely arranged photographing unit (200).

Then, the first luminance measurement step (S100) may be such that a current corresponding to a first reference gray (G1) is applied to the display panel (100) while the photographing unit (200) is arranged, to thereby light the display panel (100) and a first measurement luminance (L1) thereto is measured. Here, the first reference gray (G1) is any one gray selected from when the display panel (100) is lit.

Furthermore, when the first measurement luminance (L1) is same as the theoretical luminance to be outputted from the first reference gray (G1), the display panel (100) may not need a separate correction, but if the first measurement luminance (L1) is not same as the theoretical luminance to be outputted from the first reference gray (G1), correction is required.

To put it differently, the first measurement gray (L1) may be a state in which an error is generated from the luminance to be actually outputted from the first reference gray (G1). As stated above, a first luminance measurement step (S100) is progressed to first measure the first measurement luminance (L1) of the display panel (100) that is lit after the first reference gray (G1) is set.

Thereafter, the luminance is additionally measured by lighting another gray adjacent to the first reference gray (G1)

through which a first gamma curve deriving step (S200) is implemented to derive changes in luminance in the display panel (100).

To be more specific, the first gamma curve deriving step (S200) may be to measure a luminance at a relevant point by setting other gray within an adjacent area based the first reference gray (G1) through which changes in luminance in response to changes in gray is derived.

In more details, as illustrated in FIG. 3, the first gamma curve deriving step (S200) may first derive a first measurement area (A1) adjacent to the first reference gray (G1) (S210). Here, the first measurement area (A1) may mean a partial area adjacent to the first reference gray (G1), and may set a first comparison gray (G1+Δ, G1−Δ) (described later) within the first measurement area (A1).

For example, the first measurement area (A1) may be set at an area having a +5 or −5 gray deviation based on the first reference gray (G1), which may be selectively adjusted by a user.

After deriving the first measurement area (A1), a first process setting a first comparison (G1+Δ, G1−Δ) adjacent to the first reference gray (A1) within the first measurement area (A1) may be implemented (S210).

To be more specific, the first comparison gray (G1+Δ, G1−Δ) may be set by other adjacent gray, at least more than one adjacent gray, based on the first reference gray. At this time, as elaborated above, the first comparison gray (G1+Δ, G1−Δ) may be set within the first measurement area (A1), and more than one may be selected.

Thereafter, a second process (S220) may be implemented where a relevant current may be applied to the first comparison gray (G1+Δ, G1−Δ) to light the display panel (100) and to measure the first comparison luminance (L1+Δ, L1−Δ) (S220). Here, the first comparison luminance (L1+Δ, L1−Δ) may define a relevant luminance measured by the photographing unit (200) as illustrated in FIG. 4, in response to the first comparison gray (G1+Δ, G1−Δ).

A third process (S230) may be performed where the first comparison luminance (L1+Δ, L1−Δ) corresponding to the first comparison gray (G1+Δ, G1−Δ) is derived to thereafter derive a first gamma curve (D1) using the first measurement luminance (L1) and the first comparison luminance (L1+Δ, L1-Δ) (S230). To be more specific, as illustrated in FIG. 4, the third process (S230) indicates the changes in luminance measured in response to a gray applied from the measurement object of display panel (100), which may be derived through the first measurement luminance (L1) and the first comparison luminance (L1+Δ, L1−Δ) respectively measured from the first reference gray (G1) and the first comparison gray (G1+Δ, G1−Δ).

At this time, the first gamma curve (D1), which is a degree of changes in luminance in response to a gray applied from the display panel (100), may be certified only within the first measurement area (A1) and may be in a state of not being certified. Here, the derivation of the first gamma curve (D1) through the first measurement luminance (L1) and the first comparison luminance (L1+Δ, L1−Δ) respectively measured from the first reference gray (G1) and the first comparison gray (G1+Δ, G1−Δ) may be derived from the following numerical expression 1.

$$\frac{L1}{L1+\Delta}=\left(\frac{G1}{G1+\Delta}\right)^{c} \quad \text{(Numerical Expression 1)}$$

where, L1 is first measurement luminance (L1), L1+Δ is first comparison luminance (L1+Δ, L1−Δ), G1 is first reference gray (G1), and G1−Δ is first comparison gray (G1+Δ, G1−Δ). Furthermore, C represents a change rate of the first gamma curve (D1).

As noted from the foregoing, the change rate of first gamma curve (D1) can be derived through the numerical expression 1, whereby the first gamma curve (D1) within the first measurement area (A1) can be derived.

That is, the first measurement luminance (L1), which is a luminance value corresponding to the first comparison gray (G1+Δ, G1−Δ) adjacent along with the first reference gray (G1) and the first comparison luminance (L1+Δ, L1−Δ) are respectively measured, and a change rate of luminance value in response to the changes in gray within the first measurement area (A1) are measured to derive the first gamma curve (D1).

Here, the first gamma curve (D1) can accurately derive the gamma value by measuring not only the first measurement luminance (L1) of first reference gray (G1), which is a simple point, but also measuring the first comparison luminance (L1+Δ, L1−Δ) corresponding to the plurality of first comparison grays (G1+Δ, G1−Δ) within adjacent first measurement area (A1). Through the foregoing processes, the first gamma curve deriving step (S200) is implemented and thereafter, a first target gray deriving step (S300) may be implemented.

The first target gray deriving step (S300) may set an actual luminance corresponding to the first reference gray (G1) as a first target luminance (L1'), and apply the first target luminance (L1') to the first gamma curve (D1) to derive a first target gray (G1').

To be more specific, the first target gray (G1') may correspond to an input gray for actually outputting a luminance value to be measured by the first reference gray (G1) when there is no need to make a correction by the display panel (100).

Furthermore, the first target luminance (L1') may be a luminance value to be outputted from the first reference gray (G1) when there is no need to make a correction by the display panel (100). If the display panel (100) is correctly operated, the first target gray (G1') and the first reference gray (G1) output a same luminance, but actually there is a difference.

For example, when the first reference gray (G1) is 200, the first measurement luminance (L1) measured therefrom is 80, and an actual first target luminance (L1') is 85, a current corresponding, not to the first reference gray (G1), but to the first target gray (G1'), must be applied to light the display panel (100) in order for the display panel (100) to output a luminance of 85.

Of course, although the first target luminance (L1') is a luminance value actually to be outputted from the first reference gray (G1) as elaborated in the foregoing, it is actually different from the first measurement luminance (L1), such that, in order to output the first target luminance (L1'), a current corresponding to the first target gray (G1') instead of the first reference gray (G1) must be applied.

As a result, changes in luminance value outputted in response to changes in gray inputted through the first gamma curve (D1) may be derived and a first target gray (G1') corresponding to the first target luminance (L1') may be derived using thereof.

The first target gray (G1') thus derived may be applied instead of a current corresponding to the first reference gray (G1) when the display panel (100) is lit, to thereby allow the display panel (100) being lit with a correct lamination. After the first target gray (G1') is derived, a second luminance measurement step (S400) may be additionally implemented.

The second luminance measurement step (S400) may be such that a current corresponding to a second reference gray (G2) separate from the first reference gray (G1) is applied to the display panel (100) to light the display panel (100) and to measure a second measurement luminance (L2) thereto.

To be more specific, the second luminance measurement step (S400) may be processed separately from the first luminance measurement step (S100), where the second reference gray (G2) is set, and a current thereto is applied to light the display panel (100). Furthermore, the second measurement luminance (L2) is measured through the photographing unit (200) when the display panel (100) is lit.

Here, it is preferable that the second reference gray (G2) be disposed at an outside of the first measurement area (A1), and not be adjacent to the first reference gray (G1). That is, the second luminance measurement step (S400) is akin to the first luminance measurement step (S100), and may independently set the second reference gray (G2) to derive the second measurement luminance (L2). Successively, the second measurement luminance (L2) may be measured to allow a second gamma curve deriving step (S500) to be implemented.

The second gamma curve deriving step (S500) may be derived through a process actually same as that of the first gamma curve deriving step (S200). To be more specific, the second gamma curve deriving step (S500) may be such that an adjacent second measurement area (A2) is first derived from the second reference gray (G2). Here, the second measurement area (A2) may be set in the same standard as that of the first measurement (A1) elaborated in the second reference gray (G2).

After the second measurement area (A2) is derived as explained above, a fourth process may be implemented setting a second comparison gray (G2+Δ, G2−Δ) adjacent to the second reference gray (G2) within the second measurement area (A2).

Furthermore, a current corresponding to the second comparison gray (G2+Δ, G2−Δ) may be applied to light the display panel (100), and then a fifth process of measuring a second comparison luminance (L2+Δ, L2−Δ) may be implemented. Here, the second comparison luminance (L2+Δ, L2−Δ) may indicate a luminance measured by the photographing unit (200), as illustrated in FIG. 4, in response to the second comparison gray (G2+Δ, G2−Δ).

After the second comparison luminance (L2+Δ, L2−Δ) corresponding to the second comparison gray (G2+Δ, G2−Δ) is derived as explained above, a sixth process of deriving a second gamma curve (D2) is implemented using the second measurement luminance (L2) and the second comparison luminance (L2+Δ, L2−Δ).

To be more specific, the second gamma curve (D2) defines changes in luminance measured in response to the applied gray, as in the above first gamma curve (D1), and may be derived through the second measurement luminance (L2) and the second comparison luminance (L2+Δ, L2−Δ) respectively measured from the second reference gray (G2) and the second comparison gray (G2+Δ, G2−Δ). At this time, the second gamma curve (D2), which is a degree in which luminance is changed based on gray applied from the display panel (100), is certified only within the second measurement area (A2), and is not in a state of being certified in other areas.

Here, the second gamma curve (D2) through the second measurement luminance (L2) and the second comparison luminance (L2+Δ, L2−Δ) respectively measured from the second reference gray (G2) and the second comparison gray (G2+Δ, G2−Δ) may be derived through the following numerical expression 2.

$$\frac{L2}{L2+\Delta} = \left(\frac{G2}{G2+\Delta}\right)^{c} \quad \text{(Numerical Expression 2)}$$

Here, L2 is a second measurement luminance (L2), L2+Δ is a second comparison luminance (L2+Δ, L2−Δ), G2 is a second reference gray (G2), G2+Δ is a second comparison gray (G2+Δ, G2−Δ), and C is a change rate of second gamma curve (D2).

The change rate of second gamma curve (D2) may be derived through the numerical expression 2 as explained above, whereby the second gamma curve (D2) within the second measurement area (A2) may be derived.

As the abovementioned first gamma curve (D2), the second gamma curve (D2) can accurately derive a gamma value by measuring not only the second measurement luminance (L2) of second reference gray (G2), which is a simple point, but also the second comparison luminance (L2+Δ, L2−Δ) corresponding to the plurality of second comparison grays (G2+Δ, G2−Δ) within adjacent second measurement area (A2) thereof.

In the present exemplary embodiment, the first gamma curve (D1) and the second gamma curve (D2) may be respectively derived using the luminance value and relevant gray measured in the first measurement area (A1) and the second measurement area (A2), but actually may be also derived using a curve graph of same numerical expression as illustrated in FIG. 4.

However, because no certification was made actually on sections other than the first measurement area (A1) and the second measurement area (A2), it is preferable that the first gamma curve (D1) and the second gamma curve (D2) be mutually and separately set.

Now, a second target deriving step (S600) may be implemented after the second gamma curve (D2) is derived through the second gamma curve deriving step (S500).

The second target gray deriving step (S600) may be such that an actual luminance corresponding to the second reference gray (G2) is set as a second target luminance (L2'), and a second target gray (G2') corresponding to the second target luminance (L2') in the second gamma curve (D2) is derived.

Likewise, the second target gray (G2') may be also derived through the second gamma curve (D2) similarly to the abovementioned first target gray (G1'). A correction value deriving step (S800) may be implemented after deriving the first target gray (G1') and the second target gray (G2') respectively.

The correction value deriving step (S800) may be such that the change rate of target gray relative to the changes in reference gray is measured through the target gray (G1') and the second target gray (G2') values respectively corresponding to the first reference gray (G1) and the second reference gray (G2). Furthermore, a correction value graph may be derived, as illustrated in FIG. 5, through the measured change rate of target gray (S800).

To be more specific, the correction value deriving step (S800) may derive a correction value graph through the following numerical expression 3, as illustrated in FIG. 5.

$$G2'-G2=a(G1'-G1) \quad \text{(Numerical Expression 3)}$$

Furthermore, the correction value graph thus derived through the numerical expression 3 may be expressed by a graph of a linear functional shape as shown in the following numerical expression 4.

$$Y=aX+b \quad \text{(Numerical Expression 4)}$$

Here, X in the thus derived numerical expression 4 may correspond to a reference gray, and Y may correspond to a target gray.

As a result, the display panel (100) may be lit with a correct luminance by applying a current of the target gray value corresponding to the reference gray value using the numerical expression 4 when the display panel (100) is lit.

As the mura correction method of display panel according to the present invention is configured through the above-mentioned processes, the first gamma curve (D1) within the first measurement area (A1) based on the first reference gray (G1) can be derived, and reliability of the first gamma curve (D1) can be obtained using the first comparison luminance (L1+Δ, L1−Δ) measured through the plurality of first comparison grays (G1+Δ, G1−Δ) when the first gamma curve (D1) is derived.

Furthermore, the first target gray (G1') and the second target gray (G2') are independently derived from each of the first measurement area (A1) and the second measurement area (A2), through which a correction value graph showing the change rates of the first target gray (G1') and the second target gray (G2') in response to the changes in the first reference gray (G1) and the second reference gray (G2) can be derived, whereby the display panel (100) can be simply corrected.

Thus, the present invention can derive a gamma curve relative to a plurality of points adjacent to the correction points through which a correction value can be derived to increase the correction accuracy, unlike the prior art where only desired particular point is measured to derive a gamma at a relevant position by measuring only a particular point through which a correction value is derived.

Hence, an entire luminance of the display panel (100) can be evenly made by correction so that a luminance corresponding to a gray outputted by each pixel in the display panel (100) can be outputted.

At this time, when resolution of the display panel (100) is so high as to have excessive number of pixels, the correction value may be derived by a 4*4 block or a 8*8 block unit because of memory capacity and calculation amount of display panel (100), and luminance between blocks can be equally corrected.

Thus, the mura correction method of display panel according to the present invention can derive a correction value so that each pixel or each block can output an even luminance from the display panel (100) having a plurality of pixels, through which mura can be prevented from being generated.

As noted above, exemplary embodiments of the present invention has been described, and in addition to the aforesaid exemplary embodiments, the present invention may be embodied in other forms without departing from the purport or scope of the invention. Thus, the invention is not intended to limit the examples described herein, but is to be changed within the same scope and equal category of enclosed claims.

The invention claimed is:

1. A mura correcting method of display panel for correction when a display panel is lit, the method comprising:

applying a current corresponding to a first reference gray to the display panel to thereby light the display panel, and measuring a first measurement luminance thereto (first luminance measurement step);

measuring a luminance of adjacent other gray from the first reference gray and deriving a first gamma curve to a luminance change based on the first measurement luminance (first gamma curve deriving step);

setting an actual luminance corresponding to the first reference gray as a first target luminance, and deriving a first target gray corresponding to the first target luminance from the first gamma curve (first target gray deriving step);

lighting the display panel by applying a current corresponding to a second reference gray separate from the first reference gray and measuring a second measurement luminance thereto (second luminance measurement step);

measuring a luminance of adjacent other gray from the second reference gray and deriving a second gamma curve to a luminance change based on the second measurement luminance (second gamma curve deriving step);

setting an actual luminance corresponding to the second reference gray as a second target luminance, and deriving a second target gray corresponding to the second target luminance from the second gamma curve (second target gray deriving step); and deriving a correction value graph using a first target gray value and a second target gray value respectively corresponding to the first reference gray and the second reference gray (correction value deriving step), wherein the display panel is lit by applying a current corresponding to the corrected gray instead of relevant gray using the correction value graph when the display panel is lit.

2. The mura correcting method of display panel of claim 1, wherein the first gamma curve deriving step includes:

setting a different first comparison gray within a pre-set first measurement area that is adjacent to the first reference gray (first process);

lighting the display panel by applying to the display panel a current corresponding to the first comparison gray, and measuring a first comparison luminance thereto (second process); and deriving a first gamma curve relative to a luminance value change within the first measurement area by using the first measurement luminance and the first comparison luminance (third process).

3. The mura correcting method of display panel of claim 1, wherein the second gamma curve deriving step includes:

setting a different second comparison gray within a pre-set second measurement area that is adjacent to the second reference gray (fourth process);

lighting the display panel by applying to the display panel a current corresponding to the second comparison gray, and measuring a second comparison luminance thereto (fifth process); and deriving a second gamma curve relative to a luminance value change within the second measurement area by using the second measurement luminance and the second comparison luminance (sixth process).

4. The mura correcting method of display panel of claim 1, wherein the correction value deriving step includes deriving a slope (a) of the correction value graph using a numerical expression of G2'−G2=(G1'−G1), where G1: first reference gray G1': first target gray G2: second reference gray G2': second target gray.

5. The mura correcting method of display panel of claim 1, wherein the correction value graph is derived by a graph with a shape of linear function where a reference gray value and a target gray value respectively form an axis, wherein the display panel is lit by inputting the target gray value corresponding to the reference gray value.

* * * * *